United States Patent [19]

Wunner

[11] Patent Number: 4,823,564

[45] Date of Patent: Apr. 25, 1989

[54] DEVICE FOR CLAMPING WEFT THREADS IN A WARP KNITTING MACHINE

[75] Inventor: Roland Wunner, Schwarzenbach, Fed. Rep. of Germany

[73] Assignee: LIBA Maschinenfabrik GmbH, Fed. Rep. of Germany

[21] Appl. No.: 230,904

[22] Filed: Aug. 11, 1988

[30] Foreign Application Priority Data

Sep. 2, 1987 [DE] Fed. Rep. of Germany ..... 3729344

[51] Int. Cl.[4] ..... D04B 23/06

[52] U.S. Cl. ..... 66/84 A; 66/85 A

[58] Field of Search ..... 66/84 A, 85 A

[56] References Cited

U.S. PATENT DOCUMENTS

| | | | |
|---|---|---|---|
| 3,523,432 | 8/1970 | Vaja et al. | 66/84 A UX |
| 3,653,105 | 4/1972 | Klaeui | 66/85 A X |
| 3,680,332 | 8/1972 | Bassist | 66/84 A |
| 3,699,783 | 10/1972 | Carman | 66/84 A |
| 3,705,503 | 12/1972 | Skopalik et al. | 66/84 A |
| 4,123,920 | 11/1978 | Bassist | 66/84 A |
| 4,638,647 | 1/1987 | Grenzendoerfer | 66/85 A X |

*Primary Examiner*—Ronald Feldbaum

*Attorney, Agent, or Firm*—Bell, Seltzer, Park & Gibson

[57] ABSTRACT

The weft threads (10) are clamped in weft thread hooks (12) supported on longitudinal conveyors (43, 44) extending perpendicular to and adjacent opposite ends of a row of knitting needles (42) by means of clamping slides (20) mounted on the longitudinal conveyors (43, 44). The clamping slides (20) are supported for sliding movement in a perpendicular direction relative to the movement of the longitudinal conveyors (43, 44) and are movable between an inactive, retracted position away from the hooks (12) through a placement zone (E) and an active position pressed against the hooks (12) and the weft threads (10) as the longitudinal conveyors (43, 44) move through a clamping zone (K) extending both upstream and downstream of the row of knitting needles (42).

7 Claims, 3 Drawing Sheets

DEVICE FOR CLAMPING WEFT THREADS IN A WARP KNITTING MACHINE

FIELD OF THE INVENTION

This invention relates generally to a device for clamping weft threads in a warp knitting machine, and more particularly to such a device which includes thread clamping slides mounted on longitudinal conveyors extending perpendicular to and adjacent opposite ends of the row of knitting needles and including operating means for selectively moving the slides between a retracted position and an active position in which the slides are pressed against the weft thread hooks.

BACKGROUND OF THE INVENTION

One type of device for clamping weft threads in a warp knitting machine is disclosed in DE-OS No. 20 12 114. In this type of device the clamping part includes a pressure wheel which is formed of elastic material and its circumference engages the weft thread hooks to hold in position the weft threads placed around the hooks. It is necessary to retain the weft threads against the hooks because weft thread waste pieces extend around the hooks after the weft threads have been incorporated and cut off. Unless the weft thread waste pieces are retained on the weft thread hooks, the weft threads will not remain under tension and may become loose. The pressure wheel is positioned at the same position as the weft thread cutting location and is rotated by the weft thread hooks as they move forwardly so that the inward pressure of the pressure wheel engages and presses against at least two hooks during its rotation, because of the diameter and elasticity of the pressure wheel. The pressure wheel thus acts only with a relatively short clamping zone as the longitudinal conveyors are advanced so that the clamping of the weft threads by the pressure wheel takes place over a short weft thread racking zone as the weft threads extend back and forth between the opposite longitudinal conveyors. As a greater number of weft threads are placed on the hooks by the thread guide, the weft threads will be laid on top of one another in certain hooks and must be clamped in this position by the pressure wheel. This may lead to the release of certain of the weft yarns, particularly when very smooth and slick yarns are employed, so that the tension in the weft threads can be released and allow the yarns to slip back in relation to the hooks and the pressure wheel.

In an attempt to overcome this problem of the short clamping zone provided by the pressure wheel, it has been proposed that the pressure wheel be elongated to form a kind of revolving caterpillar so that a pressure belt is pressed against the hooks by sequentially arranged pressure rolls. With this arrangement, the weft thread clamping zone is lengthened, in accordance with the length of the caterpillar pressure belt. In this arrangement, the pressure belt is moved along by friction against the hooks and the weft threads, in a similar manner as described above for the pressure wheel. This pressure belt arrangement also does not always operate satisfactorily, especially when weft thread arrays including a large number of threads, for example 20 weft threads, are fed to the hooks so that the hooks in the center of the array have large bunches of threads being pressed against the hooks by the pressure belt. The thickness of the bunch of weft threads is not evenly distributed throughout the weft thread waste pieces, but tapers evenly from the center to both sides and thus has to be compensated by the caterpillar pressure belt. It has been found that an even contact pressure function of the caterpillar pressure belt cannot be achieved across a large clamping zone so that, especially with warp threads having a low frictional contact with the hooks, the same problems occur as with the contact pressure wheel described above. Also, the contact pressure wheel and the contact pressure belt are each subject to a high degree of wear.

SUMMARY OF THE INVENTION

With the foregoing in mind, it is an object of the present invention to provide a device for clamping weft threads in a warp knitting machine which provides a secure clamping of the weft threads against the hooks, regardless of the number of threads to be held in each instance, which has a long wear life, and may be utilized to maintain the warp threads in pressure engagement with the hooks throughout a relatively long clamping zone.

The weft thread clamping device of the present invention includes clamping slides mounted on the longitudinal conveyors supporting the weft thread hooks and extending perpendicular to and adjacent opposite ends of the row of knitting needles. The clamping slides are mounted for sliding movement in a perpendicular direction relative to the movement of the longitudinal conveyors. Control means is provided for maintaining the slides in a retracted position away from the hooks through a placement zone and for maintaining the slides pressed against the hooks and the weft threads as the longitudinal conveyors move through a clamping zone extending both upstream and downstream of the row of knitting needles.

The configuration of the clamping slides on the longitudinal conveyor eliminates the necessity of the clamping parts to be rotated by the threads and the hooks. The clamping slides operate to press the weft threads against the hooks without any relative movement between the clamping slides and the hooks. The clamping slides are thus subjected only to static friction and, because they do not roll as a result of being carried along, no sliding friction can occur, which is largely responsible for the wear experienced when using a pressure wheel or a pressure belt. Since the clamping slides are supported for inward and outward sliding movement on the longitudinal conveyors, considerable pressure can be easily exerted by the slides on the hooks so that a high degree of efficiency can be achieved with regard to clamping the weft threads which are placed in the hooks.

The inner end portions of the clamping slides which face the hooks are preferably provided with an elastic pressure piece shaped on its outer free end to conform to the shape of the corresponding weft thread hook against which it is pressed. The shaping of the outer end of the elastic pressure piece insures that the pressure piece fits snugly against the outer surface of the hook and also insures that the pressure surface engages the hook and any weft threads which are passed between the hook and the clamping slide.

In order to impart the required inward and outward movement to the clamping slides, a guide piece is supported on the outer end portions of the slide to cooperate with a guide rail. The guide rail applies pressure on the guide piece to move the clamping slide inwardly or outwardly, depending upon the position of the guide rail, relative to the longitudinal conveyor. The guide rail can be provided with a curved cam groove or trackway into which the guide piece is mounted. In this instance, the position of the clamping slide in relation to the hooks is defined by the curved configuration of the cam groove.

It is also possible to press the clamping slides against the hooks by the tension of a spring and to hold the slide clamps in the retracted position in the placing zone by means of a guide rail so that the hooks are free to allow the weft threads to be placed therein by the weft thread carriage and thread guides. In this embodiment, the guide rail acts to withdraw or retract the clamping slide during the passage through the weft thread placing zone while the tension spring operates to move the clamping slide inwardly with the elastic pressure piece being pressed against the weft threads and the hooks in the clamping zone. Applying the contact pressure of the clamping slides by means of a tension spring has the advantage that the spring can easily compensate for various thicknesses of weft threads, or a changing number of weft threads, which are placed in the hooks.

The clamping slides are supported for perpendicular sliding movement on the longitudinal conveyors by the same parts which are used for fastening the hooks to the longitudinal conveyor to insure that the clamping slides remain in proper relationship to the hooks as they are moved inwardly to the clamping position and moved outwardly to the weft thread placing position. In particular, the hooks are attached to the inner ends of hook plates which are maintained on the longitudinal conveyor by shoulder screws and these shoulder screws also serve to support the clamp slides for sliding movement on the longitudinal conveyor.

When the warp knitting machine is being used merely for incorporating cross weft threads when a single weft thread is placed around each hook, it is possible to associate all of the hooks of one longitudinal conveyor to one slide clamp. This arrangement can also be used in cases where each weft thread includes either multiple or individual weft threads.

In instances where parallel weft threads are being incorporated in the warp knitting machine, the number of hooks can be reduced. This can occur in a weft knitting machine with a weft carriage that places one array of weft threads at a time so that the weft threads are placed after the forward movement in a parallel position to and at the same distance from the weft threads placed after the return movement. In this instance, the relevant neighboring parallel weft thread, and the two adjacent weft thread arrays form a recurring racking section in relation to the relevant longitudinal conveyor, are linked by a weft thread racking outside of the longitudinal conveyor so that the length of the longitudinal conveyor represents a multiple of the racking section. In this case, the clamping slides can be spaced along the longitudinal conveyor in such a way that each of them only operates across a limited range in the center of the racking section. In fact, it is in the center of the racking section that the number of threads placed around the hooks within this range equals the number of weft threads contained in a weft thread array. If this accumulation of threads is clamped, no problems arise when the weft threads that have just been incorporated are cut off, since their continuations into the unincorporated area, where the weft thread arrays enter the needle row, extend across the clamping point in the center of the racking section and are positively retained therein by the clamping slides.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENTS

Figure 2:
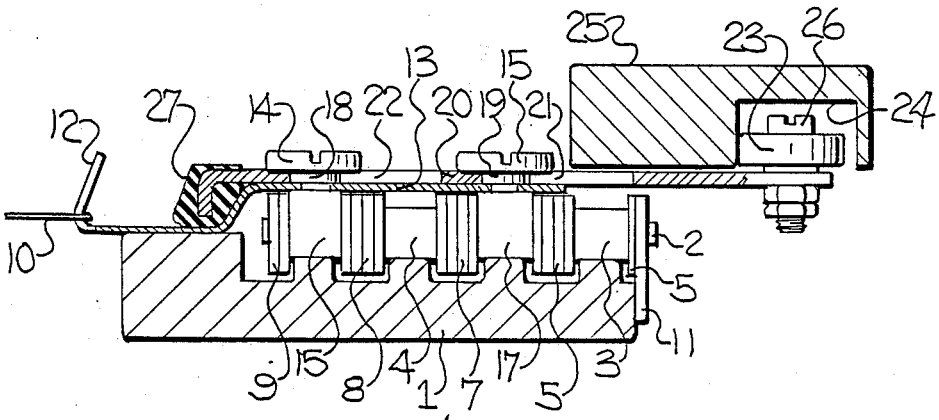
FIG. 2 is an enlarged vertical sectional view taken substantially along the line 2—2 in FIG. 1.
Figure 3:
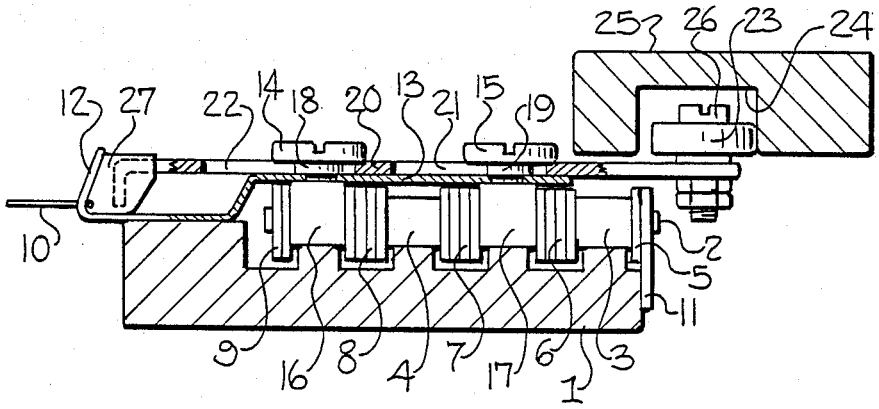
FIG. 3 is a view similar to FIG. 2 but being taken substantially along the line 3—3 in FIG. 1.

Only those portions of a warp knitting machine are shown in the drawings which are necessary to an understanding of the present invention. The warp knitting machine can be of the type illustrated in the above-mentioned DE-OS No. 20 12 114 (see particularly FIGS. 2 and 6) which is incorporated herein by reference. As best illustrated in FIGS. 2 and 3, a conveyor chain guide plate 1 supports spaced-apart longitudinal conveyors 43, 44 (FIG. 4) which extend perpendicular to and adjacent opposite ends of a row of knitting needles 42. The conveyors 43, 44 are moved forwardly in timed relationship to operation of the warp knitting machine.

Figure 1:
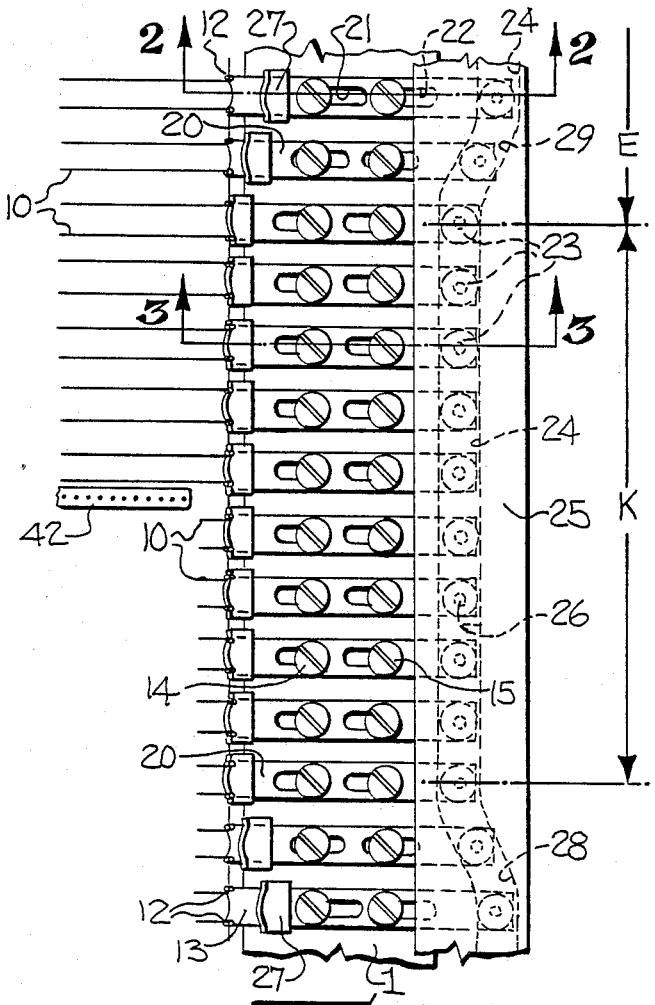
FIG. 1 is a fragmentary plan view of a portion of one longitudinal conveyor on which the clamping slides are mounted.

The details of only the longitudinal conveyor 44 are shown in FIGS. 1–3 with each chain link 2 of the longitudinal conveyor including a pair of rollers 3, 4 which are adapted to roll along on the upwardly extending projections of the guide plate 1. The individual chain links 2 are interlinked in longitudinal direction of the longitudinal conveyor by shackles or links 5, 6, 7, 8 and 9 in the conventional manner of conveyor chain construction. The tension exerted by the weft threads 10 on the individual chain links 2 applies inward pressure on the longitudinal conveyors 43, 44 to maintain a downwardly depending guide plate 11 (FIGS. 2 and 3) in sliding contact with the outer edge of the guide plate 1 as the longitudinal conveyor slides along in its forward motion.

Hooks 12 extend upwardly from the inner end of a hook plate 13 having a horizontal leg extending across and secured to the longitudinal conveyor by shoulder screws 14, 15 having their lower ends fixed in nuts 16, 17 carried by the chain link 2. The shoulder screws 14, 15 include respective shoulders 18, 19 which bear against the hook plate 13, thus clamping the same to the chain link 2. The screws 14, 15 pass through a clamping slide 20 to fasten the slide 20 to the chain link 2 in a manner permitting the slide to move inwardly and outwardly. The slide 20 includes two elongated holes or slots 21, 22 in which the shoulders 18, 19 are positioned. The height of the shoulders 18, 19 is sufficient to insure that the clamping slide 20 will have sufficient play for longitudinal movement when the screws 14, 15 are tightened.

The outer end of the clamping slide 20 is provided with a guide roller 23 which moves along a cam groove 24 in the lower surface of a guide rail 25 so that the roller 23 and the slide 20 are moved inwardly and outwardly by the cam groove 24. The roller 23 is supported for rotational movement on the outer end of the slide 20 by means of a screw 26. A pressure piece 27 is attached to the inner end of the slide 20 and is made of elastic material, such as rubber, and is adapted to the shape of the pair of hooks 12 on the inner end of the hook plate 13.

FIG. 2 illustrates the pressure piece 27 spaced outwardly from the hooks 12 while FIG. 3 illustrates the pressure piece 27 moved inwardly and pressed against the hooks 12. The inward and outward movement of the clamping slide 20 is controlled by the cam groove 24 in the guide rail 25. The inward and outward movement of the slide 20 is indicated by the dotted line illustration of the cam groove 24 in FIG. 1. When the clamping slide 20 is moved inwardly, the weft thread 10, placed in the hooks 12, is firmly pressed into the hooks 12 and clamped by the pressure piece 27.

A fragmentary plan view of one portion of one of the longitudinal conveyors is shown in FIG. 1 with the hooks 12 being supported on the inner ends of adjacent hook plates 13. Each clamping slide 20 interacts with a pair of hooks 12 so that all of the hooks 12 of the longitudinal conveyor are acted upon by the corresponding pressure pieces 27 on the inner ends of the clamping slides 20. The rollers 23 of the slides 20 are guided by the cam groove 24 extending inwardly beneath the guide rail 25. As shown in dotted lines, the cam groove 24 includes an outwardly directed cam surface 28 and an inwardly directed cam surface 29 to define a clamping zone K therebetween. In this clamping zone K the slides 20, with their pressure pieces 27, press against the hooks 12. The clamping zone K extends both upstream and downstream of the row of knitting needles 42. In the areas above and below the clamping zone K the slides 20 are moved outwardly and retained in retracted position so that the pressure pieces 27 move outwardly away from the hooks 12 to provide placement zones E.

Figure 5:
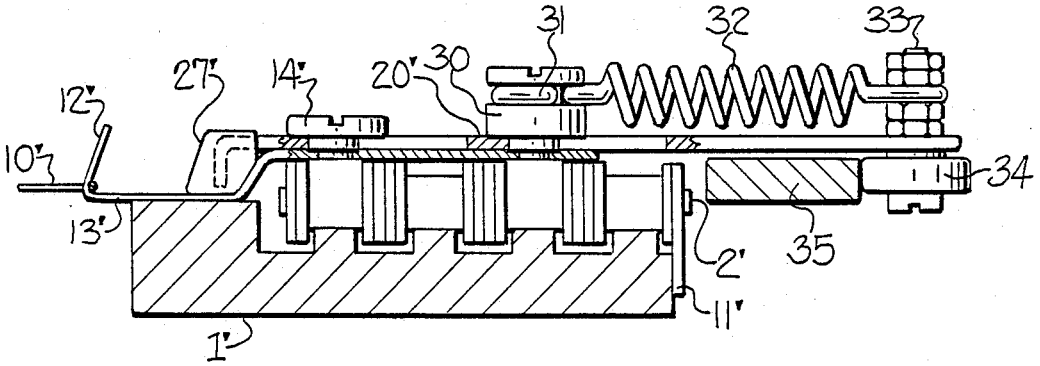
FIG. 5 is a view similar to FIG. 2 but illustrating a modified form of clamp slide in retracted position.
Figure 6:
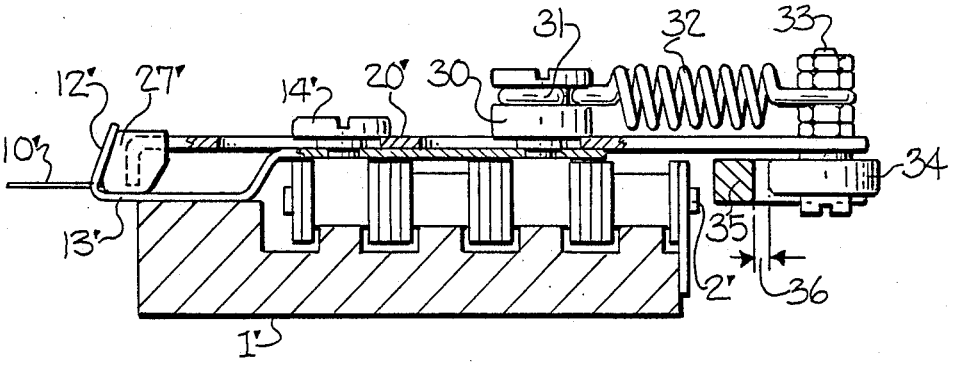
FIG. 6 is a view similar to FIG. 5 and illustrating the modified slide clamp in a clamping position.

FIGS. 5 and 6 illustrate a modified form of clamping slide 20' which is similar to the slide illustrated in FIGS. 2 and 3. However, the slide 20' of FIGS. 5 and 6 operates in a different manner from the slide 20 of FIGS. 2 and 3. In the embodiment shown in FIGS. 5 and 6, the screw 15 has been replaced by a shoulder screw 30 provided with an upstanding portion having a groove therein providing a spring perch for the bent end 31 of a tension spring 32. The other end of the spring 32 is fixed on a bolt 33 on which a cam roller 34 is rotatably supported beneath the outer end of the slide 20'. The cam roller 34 is adapted to ride against the outer surface of a guide rail 35. The tension of the tension spring 32 insures that the cam roller 34, and thus the pressure piece 27', is constantly pulled toward the hooks 12'.

The outer surface of the guide rail 35, against which the roller 34 rolls, corresponds in shape with the corresponding side of the cam groove 24, as shown in FIG. 1. As the longitudinal conveyor advances forwardly, the roller 34, carried by the outer end of the slide 20', is moved along in accordance with the configuration of the outer surface of the guide rail 35. In the position shown in FIG. 5, the guide rail 35 pulls the cam roller 34 and the slide 20' away from the hooks 12'. When the cam roller 34 reaches that area of the guide rail 35 that corresponds with the clamping zone K, the pull of the spring 32 moves the slide 20' toward the hooks 12' until the pressure piece 27' is pressed into the hooks 12'. In order to achieve a secure contact pressure between the pressure piece 2' and the hooks 12' and against the several weft threads 10' being placed in the hooks 1', the cam roller 34 is spaced from the cam surface of the guide rail 35, as indicated by the space 36 in FIG. 6.

Figure 4:
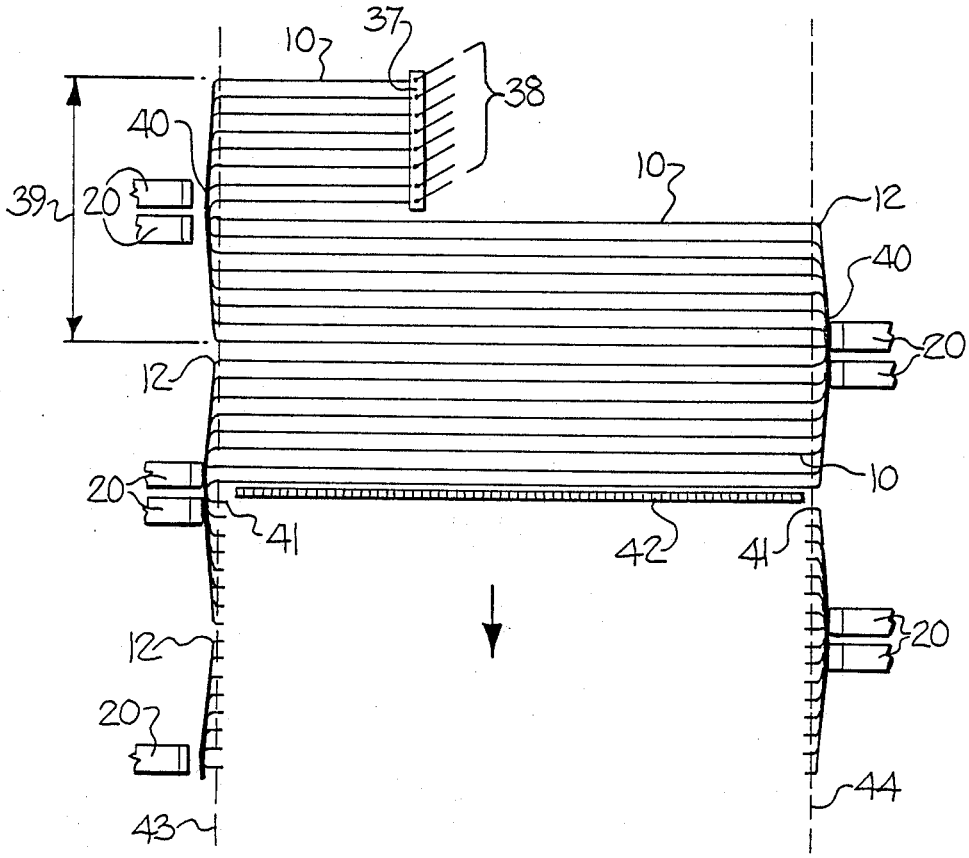
FIG. 4 is a somewhat schematic plan view illustrating weft thread arrays being placed back and forth between longitudinal conveyors positioned adjacent opposite ends of the row of needles.

FIG. 4 schematically illustrates the hooks 12 of the two longitudinal conveyors 43, 44 supporting arrays 38 of weft threads 10 which are placed into each of the hooks 12 by a thread guide 37 of a weft carriage, not shown. Racking rakes, not shown, but illustrated in DE-OS No. 20 12 114 (see particularly rakes 52, 160 of FIGS. 7 and 8), are utilized to rack each weft thread array 38 outside of the longitudinal conveyors 33, 34 by the width of the weft thread array 38 so that the usual type parallel weft is laid in a conventional manner. In this parallel weft arrangement, all of the weft threads 10 run parallel to one another and at equal distance from the adjacent weft thread.

This method of laying parallel weft threads results in a recurrence of racking section 39 consisting of two adjacent weft thread arrays 38. Outside of the hooks 12, the weft threads 10 form weft thread waste pieces 40 to be cut off after the weft threads 10 move forwardly of the row of knitting needles 42. These weft thread waste pieces 40 increase in number from the outermost weft thread 10 in a racking section 39 toward the center and in the center of each racking section 39, the number of weft threads lying outside of the corresponding hooks 12 equals the number of weft threads 10 contained in a weft thread array 38. When the clamping of the weft threads is effected by a pair of the clamping slides 20 only in the range of this maximum accumulation, as illustrated in FIG. 6, the placed weft threads 10 are secured even after the cutting point 41, downstream of the needle row 42, so that they are securely clamped by the pair of clamping slides 20 and the corresponding pressure pieces 27 carried thereby.

In the modification shown in FIG. 4, the weft thread arrays 38 repeatedly form the racking sections 39 and the length of each longitudinal conveyor 43, 44, with the hooks 12, forms a multiple of the racking sections 39. Under this condition, it is possible to provide only the pairs of adjacent clamping slides 20, illustrated in FIG. 4, at the points of maximum accumulation of weft thread waste pieces 40. Thus, it is not necessary to provide all of the hooks 12 with slides 20. The placing of weft threads 10 with regularly recurring racking sections thus permits a significant savings in the number of clamping slides 20 required.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. A device for clamping weft threads in a warp knitting machine including a row of knitting needles (42), weft thread hooks (12) supported on longitudinal conveyors (43, 44) extending perpendicular to and adjacent opposite ends of said row of knitting needles (42), a weft thread guide carriage (37) supported for back-and-forth movement between said weft thread hooks (12) for feeding weft thread arrays (38) so that weft thread waste portions extend around the outsides of said hooks (12) while the weft threads (10) are cut adjacent opposite ends of said row of knitting needles (42) with said hooks (12) forming one part of clamping means interacting with the hooks, the combination therewith wherein the other part of said clamping means comprises clamping slides (20) mounted on said longitudinal conveyors (43, 44) for sliding movement in a perpendicular direction relative to the movement of said longitudinal conveyors (43, 44), means for maintaining said clamping slides (20) in a retracted position away from said hooks (12) through a placement zone (E) located upstream of said row of knitting needles (42), and for maintaining said slides (20) in active position pressed against said hooks (12) and the weft thread (10) as said longitudinal conveyors (43, 44) move through a clamping zone (K) extending both upstream and downstream of said row of knitting needles (42).

2. A weft thread clamping device according to Claim 1 including an elastic pressure piece (27) mounted on the inner end of each of said clamping slides (20) and including an inner end portion shaped to conform to the shape of said hooks (12).

3. A weft thread clamping device according to Claim 1 wherein said means for maintaining said clamping slides (20) in retracted and active positions includes a guide member (23, 34) supported on the outer end of each of said slides (20), and a cam guide (25, 35) in engagement with said guide member to impart inward and outward movement to said clamping slides (20).

4. A weft thread clamping device according to claim 3 including a tension spring (32) operable to impart inward movement to said clamping slides (20) in said clamping zone (K) and being moved to the retracted position in said placement zone (E) by means of said cam surface (35).

5. A weft thread clamping device according to Claim 1 wherein said clamping slides (20) are supported for inward and outward sliding movement on said longitudinal conveyors (43, 44) by fixing means (14, 15, 30).

6. A weft thread clamping device according to claim 1 wherein said clamping slides (20) are supported on said longitudinal conveyors (43, 44) adjacent selected spaced-apart pairs of said hooks (12).

7. A weft thread clamping device according to claim 1 wherein a clamping slide (20) is supported for inward and outward movement for interaction with each of adjacent pairs of said hooks (12) throughout the length of said longitudinal conveyors (43, 44).

* * * * *